US006789266B1

(12) United States Patent
Mills et al.

(10) Patent No.: US 6,789,266 B1
(45) Date of Patent: Sep. 14, 2004

(54) HEAD GEAR SYSTEM

(76) Inventors: Peter John Mills, 9251 Star Trail, New Port Richey, FL (US) 34654; Kathy J. Mills, 9251 Star Trail, New Port Richey, FL (US) 34654

( * ) Notice: Subject to any disclaimer, the term of this patent is extended or adjusted under 35 U.S.C. 154(b) by 0 days.

(21) Appl. No.: 10/372,157

(22) Filed: Feb. 21, 2003

(51) Int. Cl.[7] ..... A42B 1/06

(52) U.S. Cl. ..... 2/172; 2/202; 2/209.11; 2/918

(58) Field of Search ..... 2/202, 203, 204, 2/205, 207, 171, 172, 209.11, 918

(56) References Cited

U.S. PATENT DOCUMENTS 1,414,558 A * 5/1922 Ensten ..... 2/203
1,562,838 A * 11/1925 Mahler ..... 2/172
4,110,846 A * 9/1978 Hernandez ..... 2/203
4,272,853 A * 6/1981 Schuessler ..... 2/205
4,593,417 A * 6/1986 Brown et al. ..... 2/172
5,212,837 A * 5/1993 Gose et al. ..... 2/172
D366,347 S * 1/1996 Avey ..... D29/106
5,790,986 A * 8/1998 Hall ..... 2/172
6,006,360 A * 12/1999 Reed ..... 2/202
6,678,896 B2 * 1/2004 Robinson et al. ..... 2/171.2

* cited by examiner

*Primary Examiner*—Rodney M. Lindsey

(57) ABSTRACT

A main body portion has interior and exterior surfaces. A centerline runs between the front and the back. A first side and a symmetric second side are formed. The front includes two convex edges. Stitching coupes the convex edges. The first and second sides each have first and second arcuate portions extending outwardly away from the centerline. The back includes a tail extending rearwardly away from the front from between the arcuate portions. A primary coupler includes first fasteners at the edges of the first arcuate portion on the interior surface. The first fasteners are remote from and generally parallel with the centerline. Second fasteners are provided at the edges of the second arcuate portion on the exterior surface. The second fasteners are proximal to the centerline. The first fasteners are adapted to separably couple with the second fasteners at any position along their lengths.

3 Claims, 3 Drawing Sheets

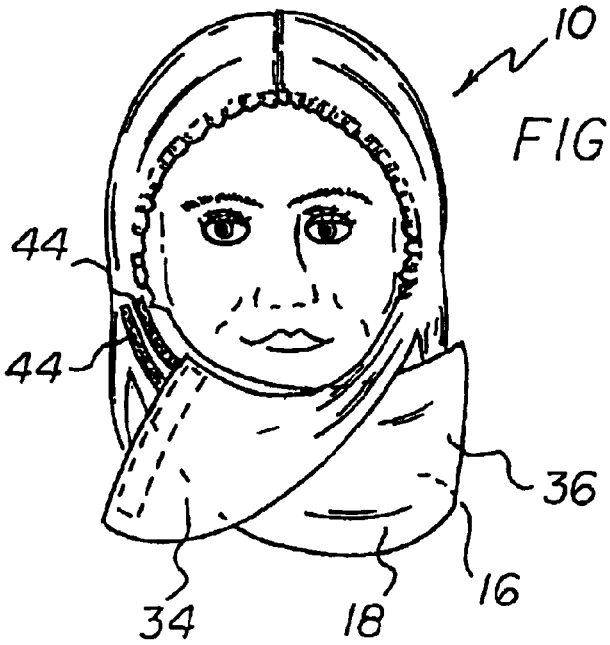
FIG 1
FIG 2
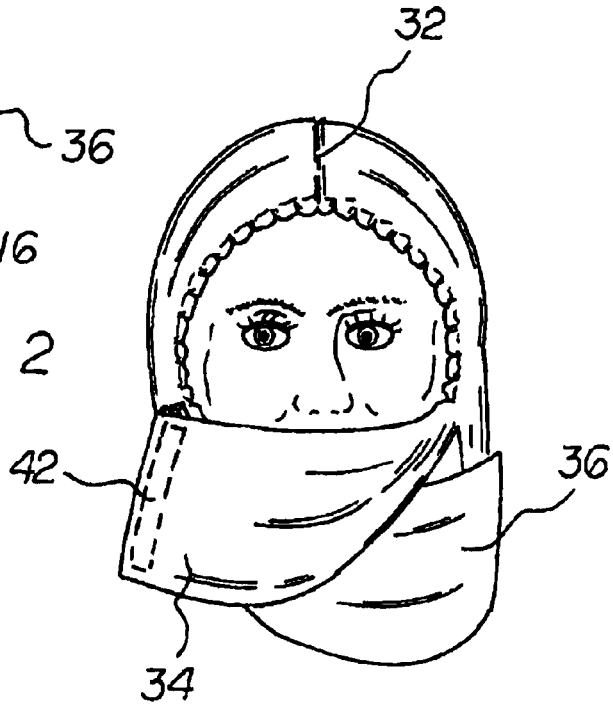
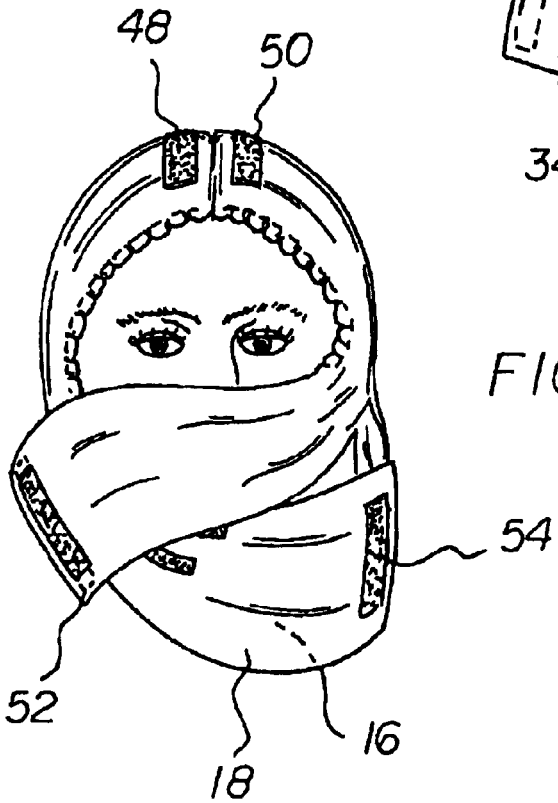
FIG 3

HEAD GEAR SYSTEM

BACKGROUND OF THE INVENTION

1. Field of the Invention

The present invention relates to a head gear system and more particularly pertains to keeping a user's head and face covered and comfortably warm in a safe and convenient manner.

2. Description of the Prior Art

The use of hats and scarfs of known designs and configurations is known in the prior art. More specifically, hats and scarfs of known designs and configurations previously devised and utilized for the purpose of keeping a user covered through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,968,521 to Bashlow relates to a combined head and neck wear. U.S. Pat. No. 4,110,846 to Hernandez relates to a combined scarf and hood. U.S. Pat. No. 4,593,417 to Brown relates to a convertible survival cap. Lastly, U.S. Pat. No. 5,115,517 to Ferguson relates to a scarf garment.

While these devices fulfill their respective, particular objectives and requirements, the aforementioned patents do not describe a head gear system that allows keeping a user's head and face covered and comfortably warm in a safe and convenient manner.

In this respect, the head gear system according to the present invention substantially departs from the conventional concepts and designs of the prior art, and in doing so provides an apparatus primarily developed for the purpose of keeping a user's head and face covered and comfortably warm in a safe and convenient manner.

Therefore, it can be appreciated that there exists a continuing need for a new and improved head gear system which can be used for keeping a user's head and face covered and comfortably warm in a safe and convenient manner. In this regard, the present invention substantially fulfills this need.

SUMMARY OF THE INVENTION

In view of the foregoing disadvantages inherent in the known types of hats and scarfs of known designs and configurations now present in the prior art, the present invention provides an improved head gear system. As such, the general purpose of the present invention, which will be described subsequently in greater detail, is to provide a new and improved head gear system and method which has all the advantages of the prior art and none of the disadvantages.

To attain this, the present invention essentially comprises a main body portion. The main body portion is fabricated from a single sheet of a woven material. The main body portion has an interior surface. The main body portion also has an exterior surface. The main body portion has a front and a back. A centerline runs between the front and the back. In this manner a first side and a symmetric second side are provided. The front includes two convex edges. The convex edges have stitching. The stitching couples the convex edges. The convex edges are positionable on the top of a wearer's head during use. The first side and the second side each have first and second arcuate portions. The arcuate portions extend outwardly away from the centerline. The arcuate portions are positionable over the wearer's face and neck front during use. The back includes a tail. The tail extends rearwardly away from the front from between the arcuate portions. The tail is positionable over the back of the wearer's neck front during use.

A primary coupler is provided. The primary coupler includes first strips of hook and loop fasteners. The first strips are provided at the edge of the first arcuate portion on the interior surface. The first strips are remote from and generally parallel with the centerline. The primary coupler also includes second strips of hook and loop fasteners. The second strips are provided at the edge of the second arcuate portion on the exterior surface. The second strips are proximal and at an angle of about 45 degrees with the centerline. The first strips are adapted to separably couple with the second strips at any position along their lengths. In this manner the arcuate portions may cover the wearer's neck and mouth (compare FIGS. 1 and 2).

Provided next is a secondary coupler. The secondary coupler includes two parallel third strips of hook and loop fasteners. The third strips are positioned on the exterior surface of the main body portion. The third strips are adjacent to and on opposite sides of the stitching. The secondary coupler also includes two fourth strips. The fourth strips are positioned on the exterior surface of the main body portion. The fourth strips are adjacent to the edges of the first and second arcuate portions. The fourth strips are remote from and generally parallel with the centerline. The fourth strips are adapted to separably couple with the third strips. In this manner the arcuate portions may uncover the front and sides of the wearer's neck (compare FIGS. 3 and 4).

Further provided is a tertiary coupler. The tertiary coupler includes fifth strips of hook and loop fasteners. The fifth strips are positioned along the centerline of the main body portion on the tail. The tertiary coupler also includes sixth strips of hook and loop fasteners. The sixth strips are positioned on the exterior surface of the main body portion. The sixth strips are provided adjacent to the stitching along the centerline. The fifth strips are adapted to separably couple with the sixth strips. In this manner the tail may uncover the back of the wearer's neck (compare FIGS. 5 and 6).

Provided last is a tunnel. The tunnel is formed in the edge of the main body portion. The tunnel extends from one arcuate portion to the other arcuate portion. The tunnel further extends across the stitching and the centerline. An elastic strap is provided. The elastic strap is provided within the tunnel. Strap ends are coupled to the ends of the tunnel.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved head gear system which has all of the advantages of the prior art hats and scarfs of known designs and configurations and none of the disadvantages.

It is another object of the present invention to provide a new and improved head gear system which may be easily and efficiently manufactured and marketed.

It is further an object of the present invention to provide a new and improved head gear system which is of durable and reliable constructions.

An even further object of the present invention is to provide a new and improved head gear system which is susceptible of a low cost of manufacture with regard to both materials and labor, and which accordingly is then susceptible of low prices of sale to the consuming public, thereby making such head gear system economically available to the buying public.

Even still another object of the present invention is to provide a head gear system for keeping a user's head and face covered and comfortably warm in a safe and convenient manner.

Lastly, it is an object of the present invention to provide a new and improved head gear system. A main body portion has interior and exterior surfaces. A centerline runs between the front and the back. A first side and a symmetric second side are formed. The front includes two convex edges. Stitching coupes the convex edges. The first and second sides each have first and second arcuate portions extending outwardly away from the centerline. The back includes a tail extending rearwardly away from the front from between the arcuate portions. A primary coupler includes first fasteners at the edges of the first arcuate portion on the interior surface. The first fasteners are remote from and generally parallel with the centerline. Second fasteners are provided at the edges of the second arcuate portion on the exterior surface. The second fasteners are proximal to the centerline. The first fasteners are adapted to separably couple with the second fasteners at any position along their lengths.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a head gear system constructed in accordance with the principles of the present invention.

FIG. 2 is a front elevational view similar to FIG. 1, but illustrating the primary coupler in an alternate position.

FIG. 3 is a front elevational view similar to FIGS. 1 and 2, but illustrating the secondary coupler.

The same reference numerals refer to the same parts throughout the various Figures.

DESCRIPTION OF THE PREFERRED EMBODIMENT

Figure 4:
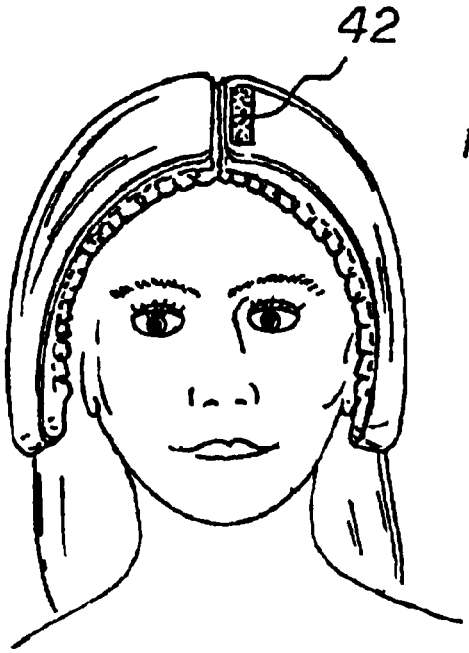
FIG. 4 is a front elevational view similar to FIGS. 3, but illustrating the secondary coupler in an alternate position.

With reference now to the drawings, and in particular to FIG. 1 thereof, the preferred embodiment of the new and improved head gear system embodying the principles and concepts of the present invention and generally designated by the reference numeral 10 will be described.

The present invention, the head gear system 10 is comprised of a plurality of components. Such components in their broadest context include a main body portion and a primary coupler. Such components are individually configured and correlated with respect to each other so as to attain the desired objective.

First provided is a main body portion 14. The main body portion is fabricated from a single sheet of a woven material. The main body portion has an interior surface 16. The main body portion also has an exterior surface 18. The main body portion has a front 20 and a back 22. A centerline 24 runs between the front and the back. In this manner a first side 26 and a symmetric second side 28 are provided. The front includes two convex edges 30. The convex edges have stitching 32. The stitching couples the convex edges. The convex edges are positionable on the top of a wearer's head during use. The first side and the second side each have first and second arcuate portions 34, 36. The arcuate portions extend outwardly away from the centerline. The arcuate portions are positionable over the wearer's face and neck front during use. The back includes a tail 38. The tail extends rearwardly away from the front from between the arcuate portions. The tail is positionable over the back of the wearer's neck front during use.

A primary coupler is provided. The primary coupler includes first strips 42 of hook and loop fasteners. The first strips are provided at the edge of the first arcuate portion on the interior surface. The first strips are remote from and generally parallel with the centerline. The primary coupler also includes second strips 44 of hook and loop fasteners. The second strips are provided at the edge of the second arcuate portion on the exterior surface. The second strips are proximal and at an angle of about 45 degrees with the centerline. The first strips are adapted to separably couple with the second strips at any position along their lengths. In this manner the arcuate portions may cover the wearer's neck and mouth (compare FIGS. 1 and 2).

Provided next is a secondary coupler. The secondary coupler includes two parallel third strips of hook and loop fasteners 48, 50. The third strips are positioned on the exterior surface of the main body portion. The third strips are adjacent to and on opposite sides of the stitching. The secondary coupler also includes two fourth strips 52, 54. The fourth strips are positioned on the exterior surface of the main body portion. The fourth strips are adjacent to the edges of the first and second arcuate portions. The fourth strips are remote from and generally parallel with the centerline. The fourth strips are adapted to separably couple with the third strips. In this manner the arcuate portions may uncover the front and sides of the wearer's neck (compare FIGS. 3 and 4).

Figure 5:
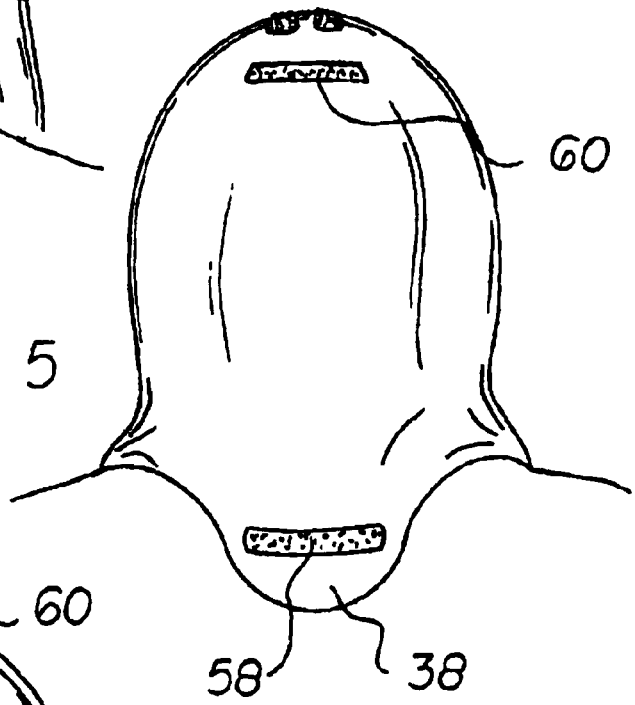
FIG. 5 is a rear elevational view illustrating the tertiary coupler.
Figure 6:
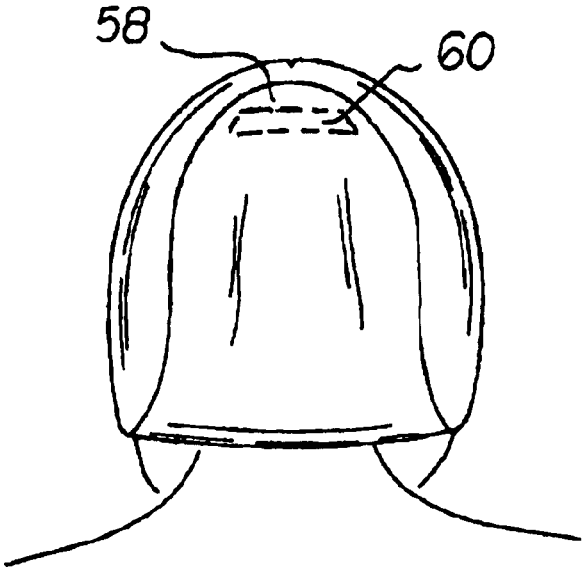
FIG. 6 rear elevational view but illustrating the tertiary coupler in an alternate position.
Figure 7:
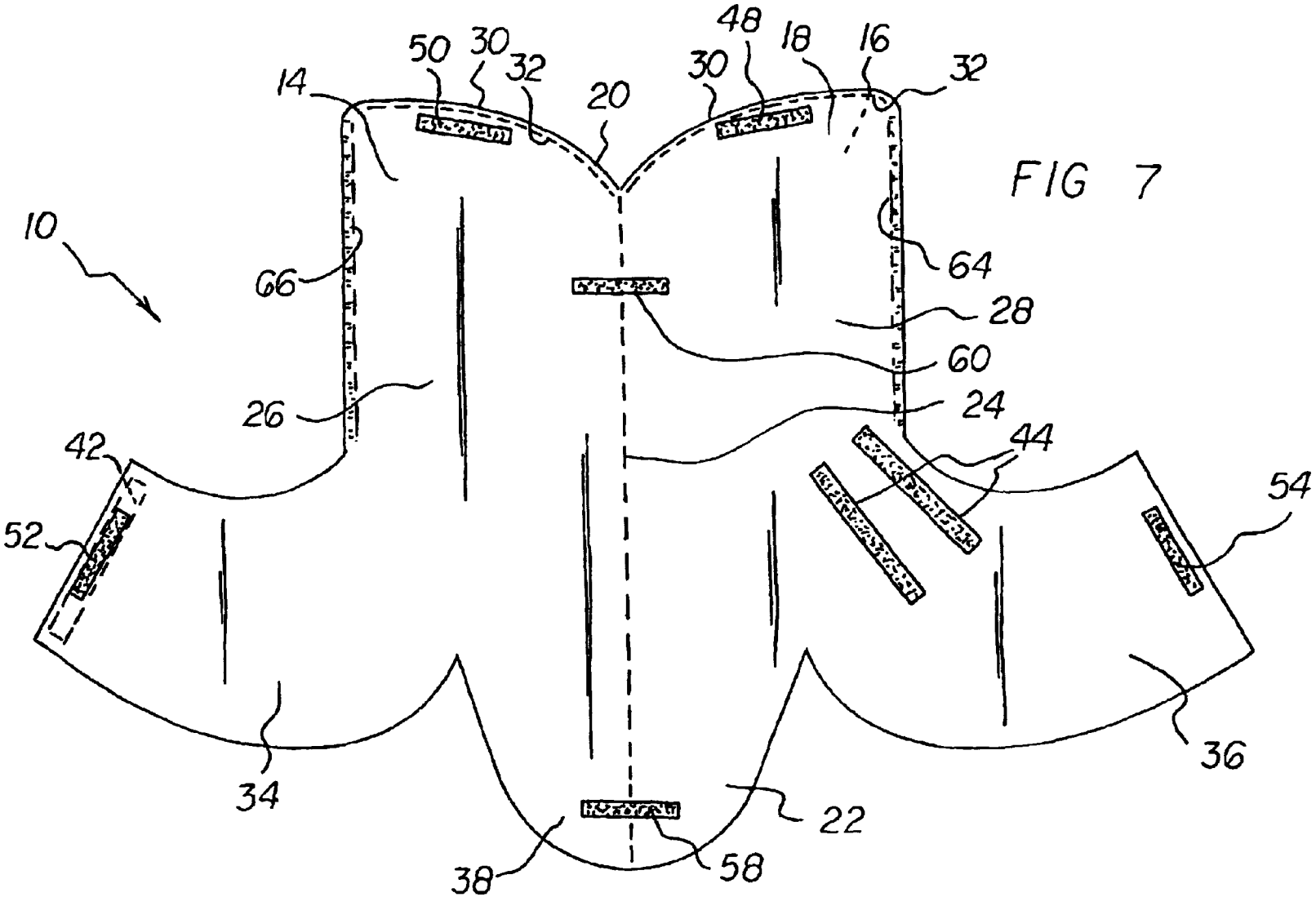
FIG. 7 is a front elevational view of the unstitched fabric utilizing the primary, secondary and tertiary couplers.

Further provided is a tertiary coupler. The tertiary coupler includes fifth strips of hook and loop fasteners 58. The fifth strips are positioned along the centerline of the main body portion on the tail. The tertiary coupler also includes sixth strips 60 of hook and loop fasteners. The sixth strips are positioned on the exterior surface of the main body portion. The sixth strips are provided adjacent to the stitching along the centerline. The fifth strips are adapted to separably couple with the sixth strips. In this manner the tail may uncover the back of the wearer's neck (compare FIGS. 5 and 6).

Provided last is a tunnel 64. The tunnel is formed in the edge of the main body portion. The tunnel extends from one arcuate portion to the other arcuate portion. The tunnel further extends across the stitching and the centerline. An elastic strap 66 is provided. The elastic strap is provided within the tunnel. Strap ends are coupled to the ends of the tunnel.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letter Patent of the United States is as follows:

1. A head gear system for allowing a user to keep his head and face covered and comfortably warm in a safe and efficient manner comprising, in combination:

a main body portion fabricated from a single sheet of a woven material with an interior surface and an exterior surface and with a front and a back and with a centerline running between the front and the back and forming a first side and a symmetric second side, the front including two convex edges with stitching coupling the convex edges and positionable on the top of a wearer's head during use, the first side and the second side each having first and second arcuate portions extending outwardly away from the centerline and positionable over the wearer's face and neck front during use, the back including a tail extending rearwardly away from the front from between the arcuate portions and positionable over the back of the wearer's neck front during use;

a primary coupler including first strips of hook and loop fasteners on the interior surface of the first arcuate portion at the edge thereof remote from the centerline and generally parallel therewith, the primary coupler also including second strips of hook and loop fasteners on the exterior surface of the second arcuate portion at the edge thereof proximal to the centerline and at an angle of about 45 degrees therewith, the first strips adapted to separably couple with the second strips at any position along their lengths to allow the arcuate portions to cover the wearer's neck and mouth;

a secondary coupler including two parallel third strips of hook and loop fasteners positioned on the exterior surface of the main body portion adjacent to and on opposite sides of the stitching, the secondary coupler also including two fourth strips positioned on the exterior surface of the main body portion adjacent edges of the first and second arcuate portions remote from the centerline and generally parallel therewith, the fourth strips adapted to separably couple with the third strips to allow the arcuate portions to uncover the front and sides of the wearer's neck;

a tertiary coupler including fifth strips of hook and loop fasteners positioned on the exterior surface of the main body portion on the tail along the centerline, the tertiary coupler also including sixth strips positioned on the exterior surface of the main body portion adjacent to the stitching along the centerline, the fifth strips adapted to separably couple with the sixth strips to allow the tail to uncover the back of the wearer's neck; and a tunnel formed in the edge of the main body portion extending from one arcuate portion to the other arcuate portion and across the stitching and the centerline with an elastic strap within the tunnel with strap ends coupled to the ends of the tunnel.

2. A head gear system comprising:

a main body portion with an interior surface and an exterior surface with a front and a back and with a centerline running between the front and the back and forming a first side and a symmetric second side, the front including two convex edges with stitching coupling the convex edges, the first side and the second side each having first and second arcuate portions extending outwardly away from the centerline, the back including a tail extending rearwardly away from the front from between the arcuate portions;

a primary coupler including first fasteners on the interior surface of the first arcuate portion at the edge thereof remote from the centerline and generally parallel therewith and second fasteners on the exterior surface of the second arcuate portion at the edge thereof proximal to the centerline, the first fasteners adapted to separably couple with the second fasteners at any position along their lengths; and, a secondary coupler including two parallel third strips of hook and loop fasteners positioned on the exterior surface of the main body portion adjacent to and on opposite sides of the stitching, the secondary coupler also including two fourth strips positioned on the exterior surface of the main body portion adjacent edges of the first and second arcuate portions remote from the centerline and generally parallel therewith, the fourth strips adapted to separably couple with the third strips to allow the arcuate portions to uncover the front and sides of the wearer's neck.

3. The system as set forth in claim 2 and further including a tertiary coupler including one fifth strip of hook and loop fasteners positioned on the exterior surface of the main body portion on the tail along the centerline, the tertiary coupler also including one sixth strip positioned on the exterior surface of the main body portion adjacent to the stitching along the centerline, the fifth strip adapted to separably couple with the sixth strip to allow the tail to uncover the back of the wearer's neck.

* * * * *